US005879765A

United States Patent [19]

Marumoto et al.

[11] Patent Number: 5,879,765

[45] Date of Patent: Mar. 9, 1999

[54] THIN METALLIC SHEET STRUCTURE HAVING SOUND DAMPING CHARACTERISTICS

[75] Inventors: Seiichi Marumoto; Tatsuya Sakiyama; Yukihisa Kuriyama, all of Futtsu, Japan

[73] Assignee: Nippon Steel Corporation, Tokyo, Japan

[21] Appl. No.: 836,112

[22] PCT Filed: Aug. 27, 1996

[86] PCT No.: PCT/JP96/02394

§ 371 Date: Apr. 21, 1997

§ 102(e) Date: Apr. 21, 1997

[87] PCT Pub. No.: WO97/08682

PCT Pub. Date: Mar. 6, 1997

[30] Foreign Application Priority Data

Aug. 31, 1995 [JP] Japan ..... 7-245186
Sep. 14, 1995 [JP] Japan ..... 7-261056

[51] Int. Cl.[6] ..... E04B 1/82; E04B 1/84; E04C 2/38

[52] U.S. Cl. ..... 428/34.2; 438/35.7; 438/35.8; 438/35.9; 438/36.2; 438/36.8; 52/144; 52/145; 52/801.1; 181/284; 181/286; 181/290; 181/294

[58] Field of Search ..... 52/144, 145, 801.1; 181/284, 286, 290, 294; 428/35.7, 35.8, 35.9, 36.8, 36.2

[56] References Cited

U.S. PATENT DOCUMENTS 2,101,568 12/1937 Woodbury ..... 52/144
2,476,499 7/1949 Lowell ..... 52/144
3,021,915 2/1962 Kemp ..... 52/145
3,402,560 9/1968 Alm ..... 52/144
4,167,598 9/1979 Logan et al. ..... 52/144

FOREIGN PATENT DOCUMENTS 36-15583 9/1961 Japan .
45-34991 11/1970 Japan .
53-156313 12/1978 Japan .
3-58081 6/1991 Japan .
3-114329 11/1991 Japan .

*Primary Examiner*—Rena L. Dye
*Attorney, Agent, or Firm*—Kenyon & Kenyon

[57] ABSTRACT

This invention provides a thin metallic sheet structure having excellent sound damping characteristics which can lower the sound pressure level of a sound inherent to a thin metallic sheet structure when this structure is patted, and can quickly damp the sound by a simple structure. In a flat sheet-like or box-like structure comprising a thin metallic external sheet and beams for reinforcing the external sheet, a thin metallic sheet structure having excellent sound damping characteristics according to the present invention employs the construction wherein the reinforcing beams 2 are brought into contact with one of the surfaces of the thin metallic external sheet 1 through a sound damping sheet 3, and the coupling state between the sound damping sheet 3 and the thin metallic external plate 1 or the reinforcing beams 2 is a non-coupling state or a discrete coupling state on at least one of the surfaces of the sound damping sheet 3.

7 Claims, 9 Drawing Sheets

THIN METALLIC SHEET STRUCTURE HAVING SOUND DAMPING CHARACTERISTICS

TECHNICAL FIELD

In structures made of thin metallic external sheets such as those used for automobiles, building materials, furniture, electrical appliances, etc, the present invention relates to a thin metallic sheet structure capable of reducing the sound generated when the external sheets are tapped or patted.

BACKGROUND ART

Outer steel structures using thin metallic sheets such as a steel sheet, for durable consumer goods such as automobiles, building materials, furniture, electrical appliances, etc, have been again examined in recent years because they are advantageous from the aspects of recycling properties, removal of detrimental substances in processing of the wastes, and ecology. When means for reducing the thickness of a metallic external sheet by supporting the external sheet by reinforcing beams so as to reduce the weight is employed, tapping the metallic external sheet is likely to spoil the commercial value of products since the metallic external sheet is generally as thin as about 1 mm. In other words, when such a thin metallic sheet is tapped or patted, a sound inherent to the metal (the sound is an offensive and low-grade noise because it is not heavy and low) occurs, and the value of the product itself might be spoiled by this noise. Particularly in the case of products for home use, tone quality and quietness of the tapping sound of the external plate, which is generated for some reason or other, is one of the important factors for providing a feeling of high quality to the product.

A sheet material produced by sandwiching a resin film between thin metallic sheets and called a "vibration-proofing steel sheet" has been used in the past as the metallic external sheet satisfying the object described above. When this material is used, sound damping characteristics can be remarkably improved, but the material is not free from the problems that the cost is high, machining performance such as bendability, drawability, etc, is inferior to a single sheet because it is a sandwiched metallic sheet, and sharp bending and drawing cannot be carried out.

Japanese Unexamined Patent Publication (Kokai) No. 62-27143 discloses a composite vibration-proofing steel sheet which can withstand bend-machining at a small bending radius by simultaneously heating and shaping a metallic sheet and a vibration-proofing material without using an adhesive, and Japanese Examined Utility Model Publication (Kokoku) No. 6-49743 describes a steel sheet for a floor produced by the steps of applying a polymer resin to a part of a bent steel sheet to obtain a thin steel sheet and bonding the thin steel sheets by a polymer resin so as to damp a sound.

These proposals are based on the premise that the thin steel sheets and a plastic material as the vibration-proofing material are finally bound together. When the structure requiring an adhesive is employed, the increase of the cost of the adhesive and the drying time render the disadvantages for the production, and deterioration of the adhesive might occur depending on temperature and the passage of time. In the case of electric home appliances, in particular, electrical components inside the casing exist under exothermic condition, and counter-measures for thermal degradation of the adhesive and for possible fire hazards become necessary.

Further, Japanese Unexamined Patent Publication (Kokai) No. 61-182820 discloses an invention wherein the ratio of thickness of three layered steel sheets is selected within a specific range and these steel sheets are locally fused so as to improve vibration-proofing performance by utilizing the friction between the metallic sheets. However, the use of the laminated steel sheets is not preferable for those products whose weight must be reduced, and various problems are yet left unsolved for applying this invention to products for which machinability and appearance are of importance.

SUMMARY OF THE INVENTION

To solve the problems described above, the present invention is directed to provide a thin metallic sheet structure having excellent sound damping characteristics which can lower the sound level of the sound, which is inherent to a metal and is generated when a thin metallic structure is tapped or patted, and can damp quickly the sound, by a simple structure.

The gist of the present invention for accomplishing the object described above resides in the following points.

(1) In a flat sheet-like or box-like structure comprising a thin metallic external sheet and beams for reinforcing the external sheet, a thin metallic sheet structure having excellent sound damping characteristics according to the present invention employs the construction wherein the reinforcing beams are brought into contact with one of the surfaces of the thin metallic external sheet through a sound damping sheet, and a coupling state between the sound damping sheet and the thin metallic external sheet or the reinforcing beams is a non-coupling state or a discrete coupling state on at least one of the surfaces of the sound damping sheet.

(2) In the thin metallic sheet structure having excellent sound damping characteristics described in the item (1), the sound damping sheet comprises a plastic sheet, paper, a rubber sheet or a woven fabric sheet.

(3) In a flat sheet-like or box-like structure comprising a thin metallic external sheet and beams for reinforcing the external sheet, a thin metallic sheet structure having excellent sound damping characteristics according to the present invention employs the construction wherein the reinforcing beam is made of a plastic material and/or a plastic composite material, and a coupling state of a contact surface between the thin metallic external sheet and the reinforcing beams is a non-coupling state or a discrete coupling state.

(4) In a flat sheet-like or box-like structure comprising a thin metallic external sheet and beams for reinforcing the external sheet, a thin metallic sheet structure having excellent sound damping characteristics according to the present invention employs the construction wherein a sound damping sheet is brought into contact with a part, or the entire surface, of one of the surfaces of the thin metallic external sheet at a non-reinforcement portion by support members, and a coupling state between the sound damping sheet and the thin metallic external sheet is a non-coupling state or a discrete coupling state.

FIG. 1 shows the basic structure of the present invention. A sound damping sheet 3 is pressed to substantially the entire inner surface of an external sheet 1 consisting of a thin metal sheet by two reinforcing beams 2 and fastening members 4 made of a metal, or the like. On the other hand, FIGS. 10(*a*) and 10(*b*) show the modified embodiments of the present invention, wherein each of two sound damping sheets 3 is pressed to the inner surface of a structure comprising a thin metallic external sheet 1 and three reinforcing members 20. The dumping sheet 3 is pressed between the reinforcing members 20, by three support members 21.

The thin metallic sheet is not particularly limited, and if any sound problem exists in a flat sheet-like or box-like structure comprising a cold rolled steel sheet, a hot rolled steel sheet, a surface treated steel sheet, an aluminum alloy sheet, a titanium sheet, a copper sheet, and so forth, the present invention can be similarly applied to them.

From the aspect of vibration damping, any material such as paper or plastic having considerable flexibility can be used for the sound damping sheet 3, and rubber and woven fabric of organic or inorganic fibers (plastics, carbon, glass, etc.) can be used. Suitable materials may be selected in consideration of the heat resistance, fire-proofness, water-proofness, etc., depending on the environment in which it is used.

The sound damping sheet 3 and the thin metallic sheet 1 need not always be in contact over the entire surface (refer to the analytical result of FIG. 6 wherein the contact state is changed by the difference of the sheet thickness of the later-appearing sound damping sheet). The thin metallic sheet 1 as the external sheet and the sound damping sheet 3 must be in mutual contact at least at the reinforcing beams and/or the support members. Due to this contact, not only absorption of the vibration occurs but also chord vibration (viscous damping vibration) of the sound damping sheet 3 occurs due to acoustic coupling with the vibration of the thin metallic external sheet 1. In consequence, a sound damping effect which is far greater than the effect of the vibration of the thin metallic sheet alone develops (refer to the later-appearing FIGS. 4 and 5).

The smaller the distance between the thin metallic external sheet 1 and the sound damping sheet 3 between the reinforcing beams 2, the higher becomes acoustic coupling. Therefore, the support width of the sound damping sheet 3 by the reinforcing beams 2 (that is, the width of the reinforcing beams) is preferably greater.

The explanation described above is given on the assumption that the thin metallic external sheet 1 and the sound damping sheet 3 are under the non-coupling state. However, the drop of the acoustic coupling effect due to deflection of the sound damping sheet 3 when the distances between the reinforcing beams 2 are great or when the sound damping sheet 3 is not supported by the reinforcing beams 2 but is merely brought into contact between the reinforcing beams 20, can be avoided.

The vibration form of the reinforcing beams is a beam vibration, whereas the vibration form of the thin metallic external sheet and the sound damping sheet is a film vibration. It is assumed that the sound damping effect in the present invention greatly relies on the frictional damping effect between the beam vibrations, and film vibrations. Therefore, when the sound damping sheet is interposed between the thin metallic external sheet and the reinforcing beams, the coupling state between the sound damping sheet and the thin metallic external sheet or the reinforcing beams is most preferably the non-coupling state in order to obtain a great sound damping effect in the proximity of the reinforcing beams. When the rigidity of the thin metallic sheet structure must be improved, however, a sufficient sound damping effect can be obtained even when the coupling state is partly a discrete coupling state. Incidentally, the term "discrete coupling state" means the coupling state in which the sound damping sheet and the thin metallic external sheet and the reinforcing beams are coupled partially with certain gaps between them but not the state where they are coupled with one another over the entire sheet surface (see FIG. 3). If the coupling state is the complete and continuous coupling state, the frictional damping effect is lost, and such a coupling state is not desirable.

FIG. 4 shows the results of analysis of the sound generated when the external plate of a box structure made of a 0.75 mm-thick thin steel sheet was patted was analyzed in terms of the time change of the sound pressure level (dB) in accordance with the frequency for each of a Comparative Example under a bare steel sheet state and an Example of the present invention wherein the sound damping sheet was added.

In comparison with the sound characteristics of the bare steel sheet structure (FIG. 4*b*), the sound generation level of the sound pressure in the structure of the present invention (FIG. 4*b*) is as low as by ¼ to ⅕ of the sound produced by the bare box and damping is also faster, as can be seen from FIG. 4.

FIG. 5 is a graph obtained by plotting again the analytical results described above in terms of the maximum sound pressure (dB) and the damping coefficient. Here, the term "damping coefficient" is the coefficient of the exponent portion obtained by conducting regression of the time change of the sound pressure by an exponential function, and represents k in the following formula:

$$\text{sound pressure} = \text{maximum sound pressure} \times \exp(-k \cdot t)$$

where k: damping coefficient t: time lapsed (second)

FIG. 5 additionally shows the results of analysis when a box structure made of a vibration-proofing steel sheet prepared by fusing two 0.3 mm-thick steel sheets by a resin film according to the prior art is tapped as a Comparative Example, and when a steel angle (L-shape: 10 mm (width) ×10 mm (height)×1 mm (thickness)×60% of length of a reinforcing beam is further bonded to a part of the reinforcing beam as an Example of the present invention and the resulting structures is tapped. It can be seen from the results of FIG. 5 that the structure of the present invention is superior in the sound pressure suppressing effect (particularly in a low sound range), has excellent damping characteristics (damping which is 3 to 5 times faster in a sound range of at least 800 Hz, in particular), and has the sound pressure suppressing effect and sound damping performance at least equal to the box structure made of the vibration-proofing steel sheet. In this way, a thin metallic sheet structure which does not generate offensive noise when patted and has excellent acoustic damping characteristics can be accomplished.

Besides metals such as steel, copper, aluminum alloy and titanium, the materials for the beams and the support members may be selected suitably from wood and plastic in accordance with a required strength, a weight limit, water-proofness, heat resistance, production cost, and so forth. If the conditions such as the required strength and the like are satisfied, a preferred structure is the one wherein the reinforcing beams are made of a plastic and/or plastic composite material and are directly pressed to the thin metallic external sheet 1, because such a structure allows the reinforcing beams function to partly exhibit the function of the sound damping sheet.

The support member 21 preferably has a flexible structure so that the sound damping sheet 3 can be brought into reliable contact with the thin metallic external sheet 1.

In the structure of the present invention, sufficient sound damping characteristics can be obtained, too, when the reinforcing beams and the thin metallic external sheet 1 are discretely bonded at portions other than the end portions of the reinforcing beams. When the thin metallic external sheet 1 serves as the external surface of the product, however, the external surface of the bonded portion must be again finished in many cases to a smooth surface from the aspect of appearance so as to avoid a drop in a commercial value. Therefore, the structure wherein the reinforcing beams 2 and the thin metallic external plate 1 are bonded only at their end portions is preferred, because the joint portions can be concealed from the external surface by so doing.

To obtain the vibration-proofing effect, it is important that the reinforcing beams 2 come into contact with the external sheet 1 through the sound damping sheet 3. Therefore, each reinforcing beam can be preferably pressed independently to the thin metallic external sheet and can be independently adjusted.

THE MOST PREFERRED EMBODIMENTS

Hereinafter, the present invention will be explained in further detail with reference to the drawings.

Figure 1A:
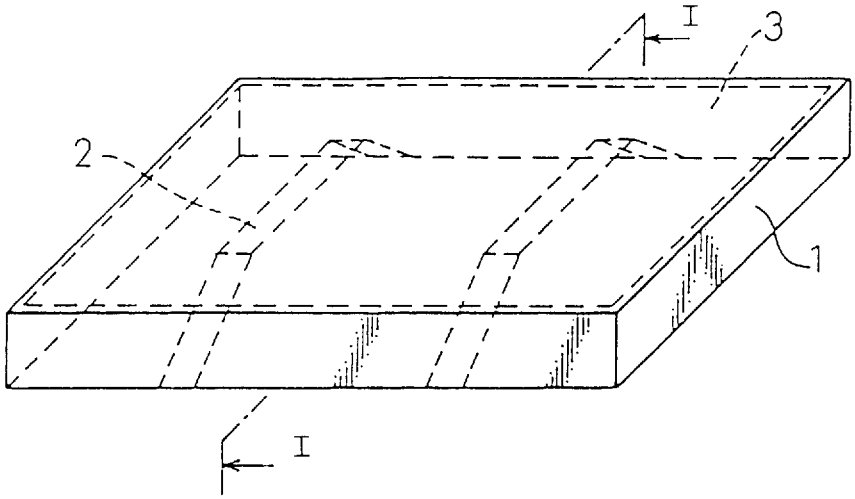
FIG. 1 shows the basic structure of the present invention, wherein FIG. 1(*a*) is a perspective view and FIG. 1(*b*) is a sectional view taken along a line A—A.
Figure 1B:
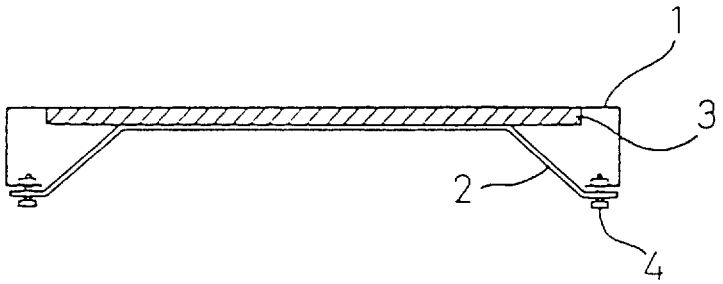

FIG. 1 shows a basic structural example of the present invention. A sound damping sheet 3 made of 0.5 mm-thick craft paper is pressed to substantially the entire internal surface of an external sheet 1 made of a 0.75 mm-thick thin steel sheet by two 1.6 mm-thick reinforcing beams 2.

Figure 2:
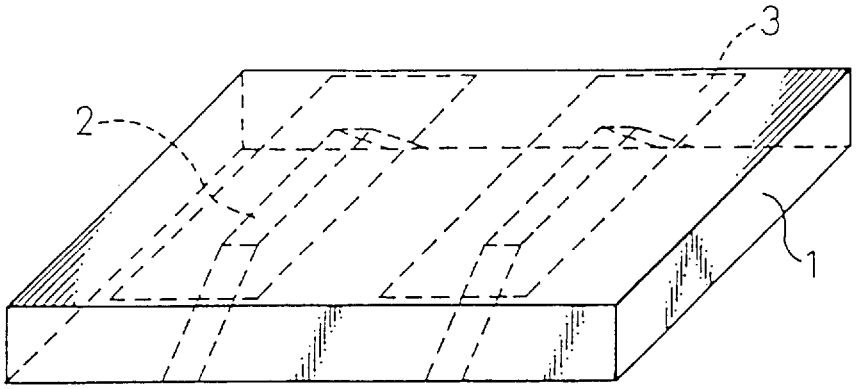
FIG. 2 shows another embodiment of the present invention wherein insertion of a sound damping sheet is partially made.

As will be later described, the maximum sound pressure can be restricted by the existence of the sound damping sheet on the reinforcing beams (see FIG. 8), and this suppression effect hardly has any relation with the width of the sound damping sheet. Therefore, if a product needs only damping of the maximum sound pressure, an economical product can be produced by bonding a rectangular sound damping sheet having a small width to the reinforcing beams 3 and partially supporting the thin metallic external sheet 1 as shown in FIG. 2.

Figure 3A:
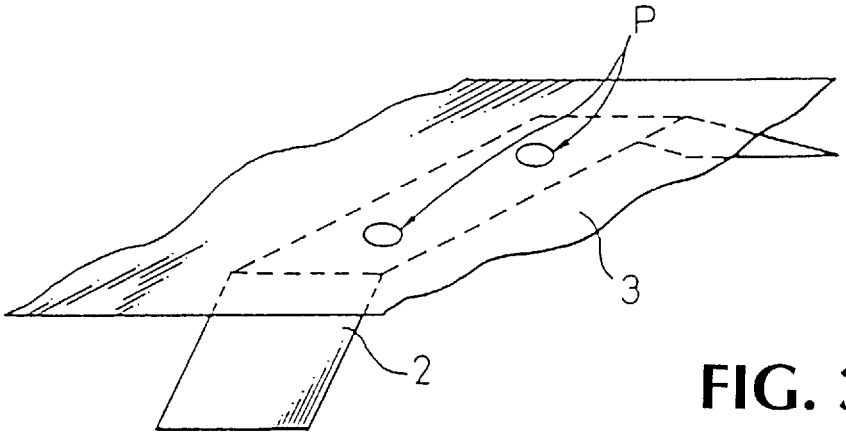
FIG. 3 shows an embodiment of the present invention wherein the sound damping sheet and reinforcing beams are mechanically bonded (simple caulking), and wherein FIG. 3(*a*) is a perspective view of principal portions and FIG. 3(*b*) is an enlarged sectional view.
Figure 3B:
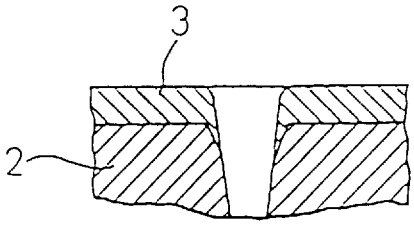
Figure 4A:
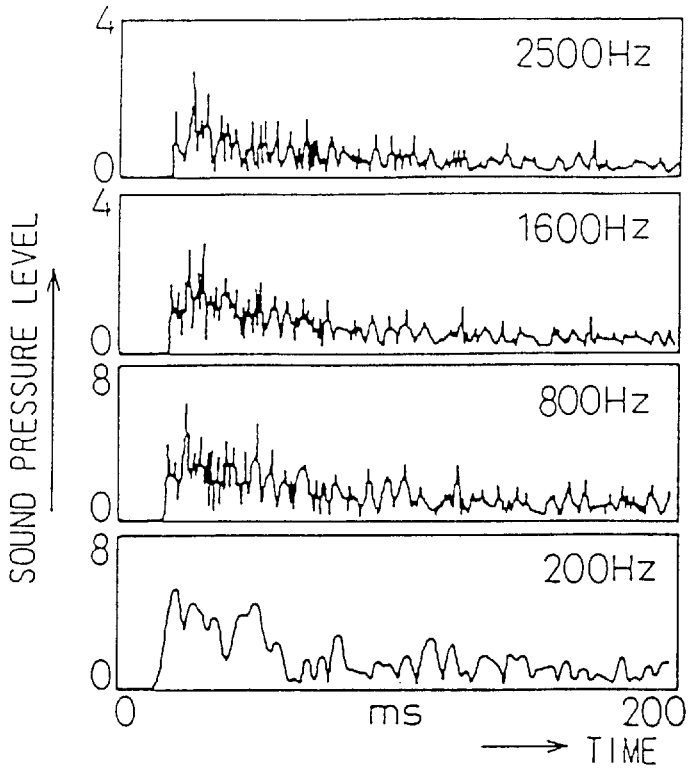
FIG. 4 is analytical diagrams showing comparatively the effects of the present invention with the effects of a Comparative Example (time axis—sound pressure), FIG. 4(*a*) shows Comparative Example and FIG. 4(*b*) shows the present invention.
Figure 4B:
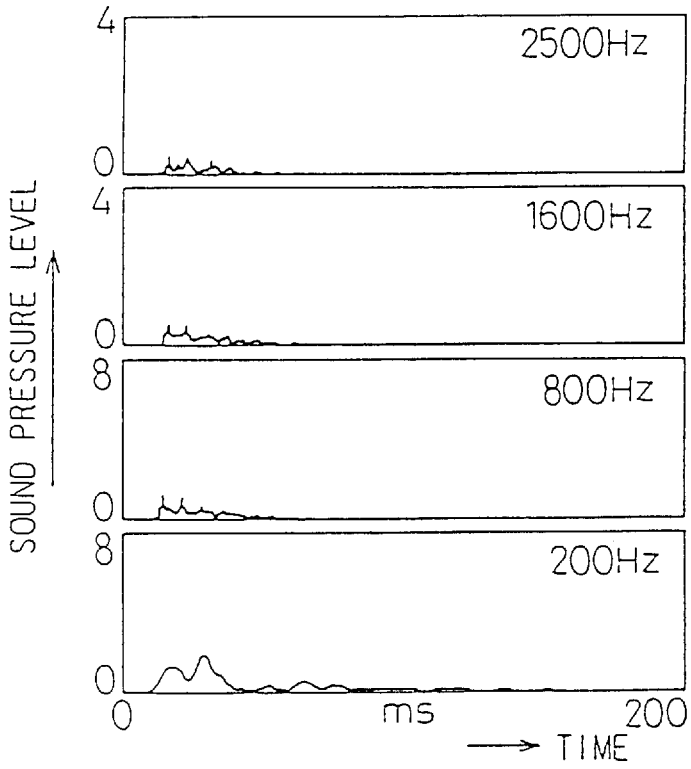
Figure 5:
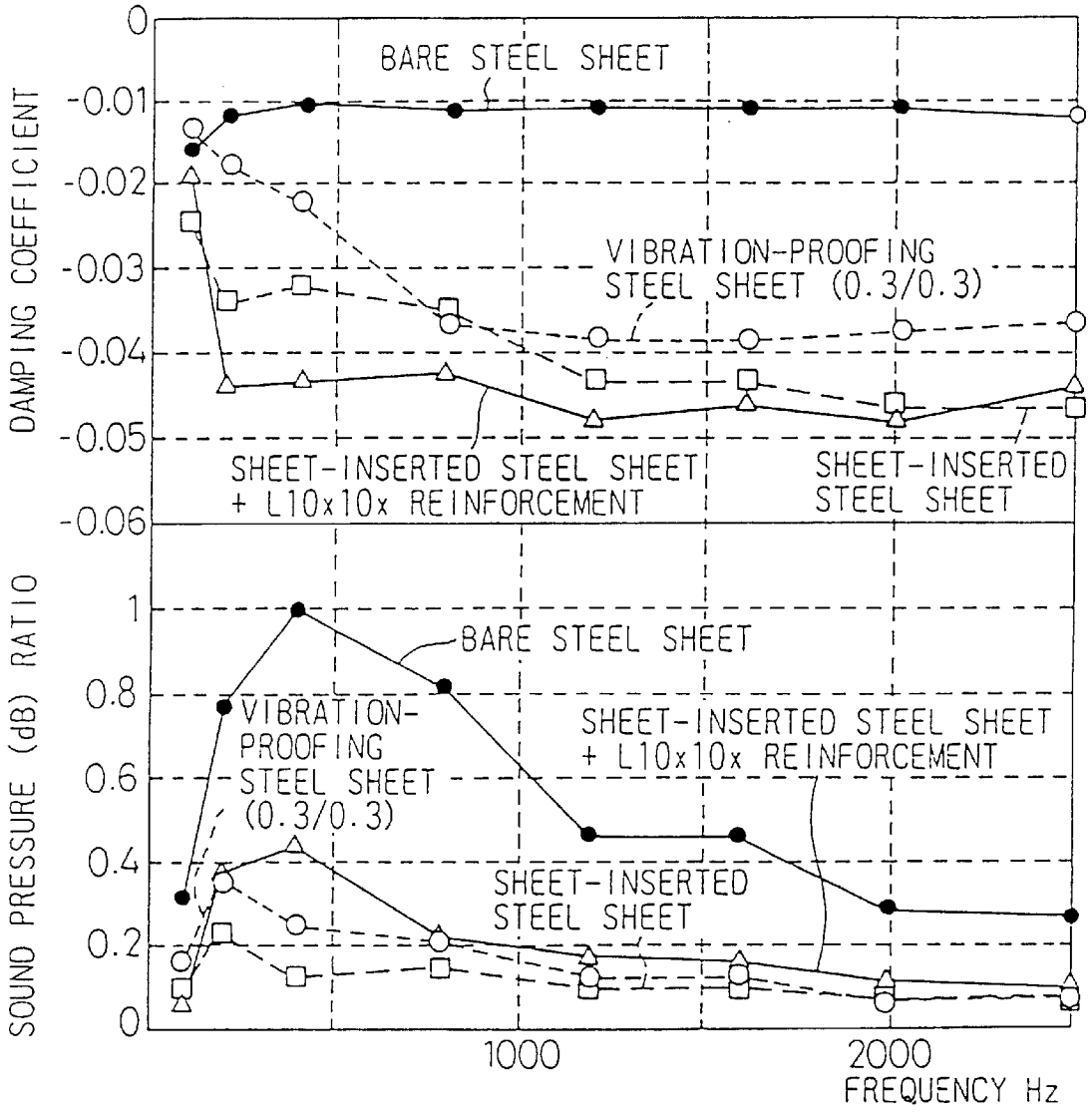
FIG. 5 is an analytical diagram showing comparatively the effects of the present invention with the effects of a Comparative Example (frequency-v-sound pressure diagram and frequency-v-damping coefficient diagram)

When this structure is employed, it becomes necessary to anchor the sound damping sheet 3 to the reinforcing beams 2, but when the sound damping sheet 3 and the reinforcing beam 2 are laminated and punching is conducted into the taper shape as shown in FIG. 3, simple caulking not requiring an adhesive can be made. When the rectangular sound damping sheet 3 having a width greater than the reinforcing beams 2 is used, the width is determined in accordance with the rigidity of the sound damping sheet 3. (For, if the rigidity of the sound damping sheet itself is low and the sound damping sheet 3 separates from the thin metallic external sheet 1 to the extent such that acoustic coupling does not occur, the sound damping sheet at the separated portion becomes the waste portion that does not provide any vibration damping effect). This structure is preferable from the aspect of the sound damping effect and effective utilization of the material of the sound damping sheet.

Figure 10A:
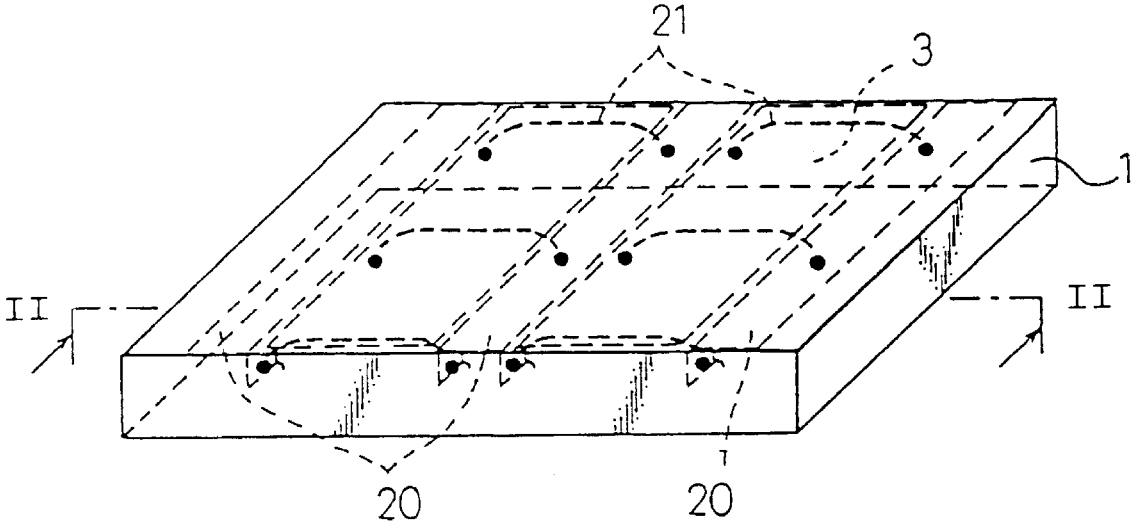
FIG. 10 shows the modified embodiments of the present invention, wherein FIG. 10(*a*) is a perspective view and FIG. 10(*b*) is a sectional view taken along a line B—B.
Figure 10B:
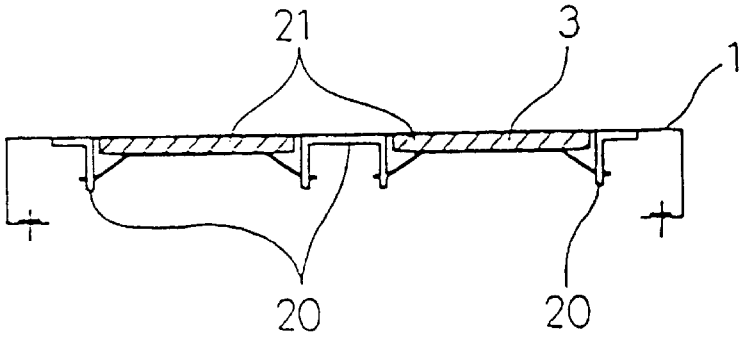

FIG. 10 shows another modified example of the present invention. The reinforcing beams 20 are directly bonded to the thin metallic external sheet 1 (by welding or bonding), and the sound damping sheet 3 is brought into contact with the film portion of the thin metallic external sheet 1 not having the reinforcing beams 2 by using the support member 21, so as to provide the sound damping effect of the sound damping sheet 3. In this modified example, since the reinforcing beams 20 are directly bonded (welded or bonded by an adhesive) to the thin metallic external sheet 1, the rigidity of the reinforcing beams can be exhibited most strongly by the simple construction. In this case, frictional damping does not develop on the reinforcing beams 20, but the sound damping effect is brought forth by frictional damping due to film vibration of the sound damping sheet 3 and its viscous damping.

Though the support members 21 are fitted in parallel to the reinforcing beams 20 in this example, they may be fitted crossly, or the support members 21 may be fitted to the end portions of the thin metallic external sheet 1 in place of the reinforcing beams 21.

EXAMPLES

The effect of the present invention will be represented further by Examples thereof.

The effect of the thickness of the sound damping sheet 3 will be explained about the example where craft paper was used for the sound damping sheet 3.

Figure 6:
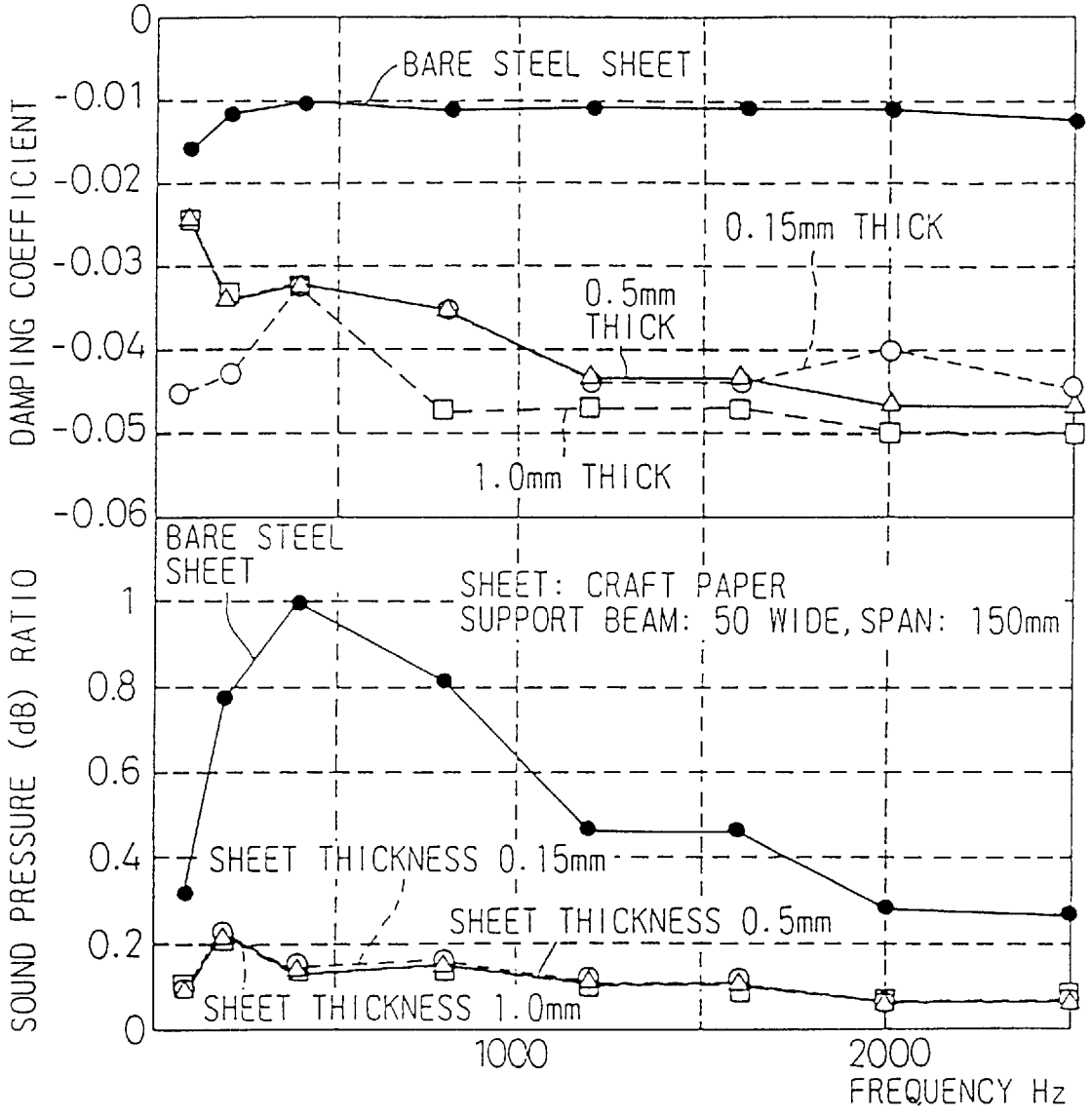
FIG. 6 is an analytical diagram showing comparatively the difference of the effects by the thickness of a sound damping sheet according to the present invention with a Comparative Example (frequency-v-sound pressure diagram and frequency-v-damping coefficient diagram)

When the thickness of craft paper is at least 0.15 mm even if the support span is 150 mm as shown in FIG. 6; sag of the craft paper due to its own weight can be kept to about 0.5 mm by the rigidity of craft paper (sound damping sheet) itself and the tension effect by the support of the reinforcing beams 2. As a result, the drop of the sound damping effect cannot be recognized.

The effect of the material of the sound damping sheet 3 will be explained by the examples which use polypropylene, polystyrene, craft paper and synthetic rubber for the sound damping sheet 3.

Figure 7:
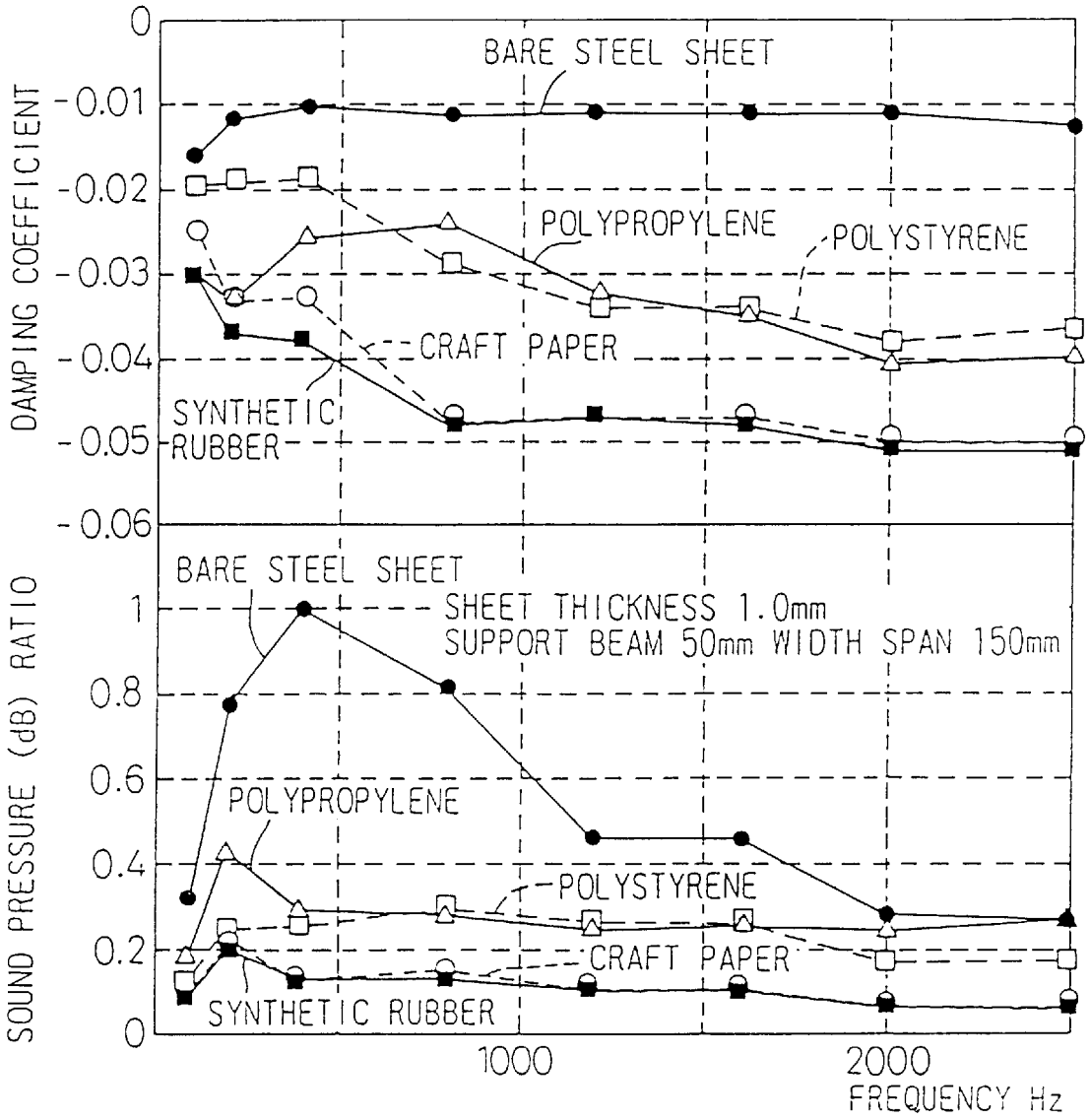
FIG. 7 is an analytical diagram showing comparatively the difference of the effects of a sound damping sheet (material) of the present invention in comparison with a Comparative Example (frequency-v-sound pressure diagram and frequency-v-damping coefficient diagram)

As shown in FIG. 7, the rubber type sound damping sheet exhibits the highest suppression effect of the maximum sound pressure and the highest sound damping effect among the examples of the present invention, and an extremely economical paper material exhibits substantially similar effect as can be seen from FIG. 7.

Though the characteristics of polypropylene and polystyrene are somewhat inferior to those of the rubber as the sound damping sheet, they are more economical in price than the rubber, and have excellent water-proofness and heat resistance. Therefore, they are materials having high utility.

The effect of the support span of the sound damping sheet 3 will be explained by an example wherein the support span is changed between 50 and 350 mm. The support span is defined by the following formula as the free span of the thin metallic external sheet 1:

support span = (distance between centers of reinforcing beams-width of reinforcing beams)

Figure 8:
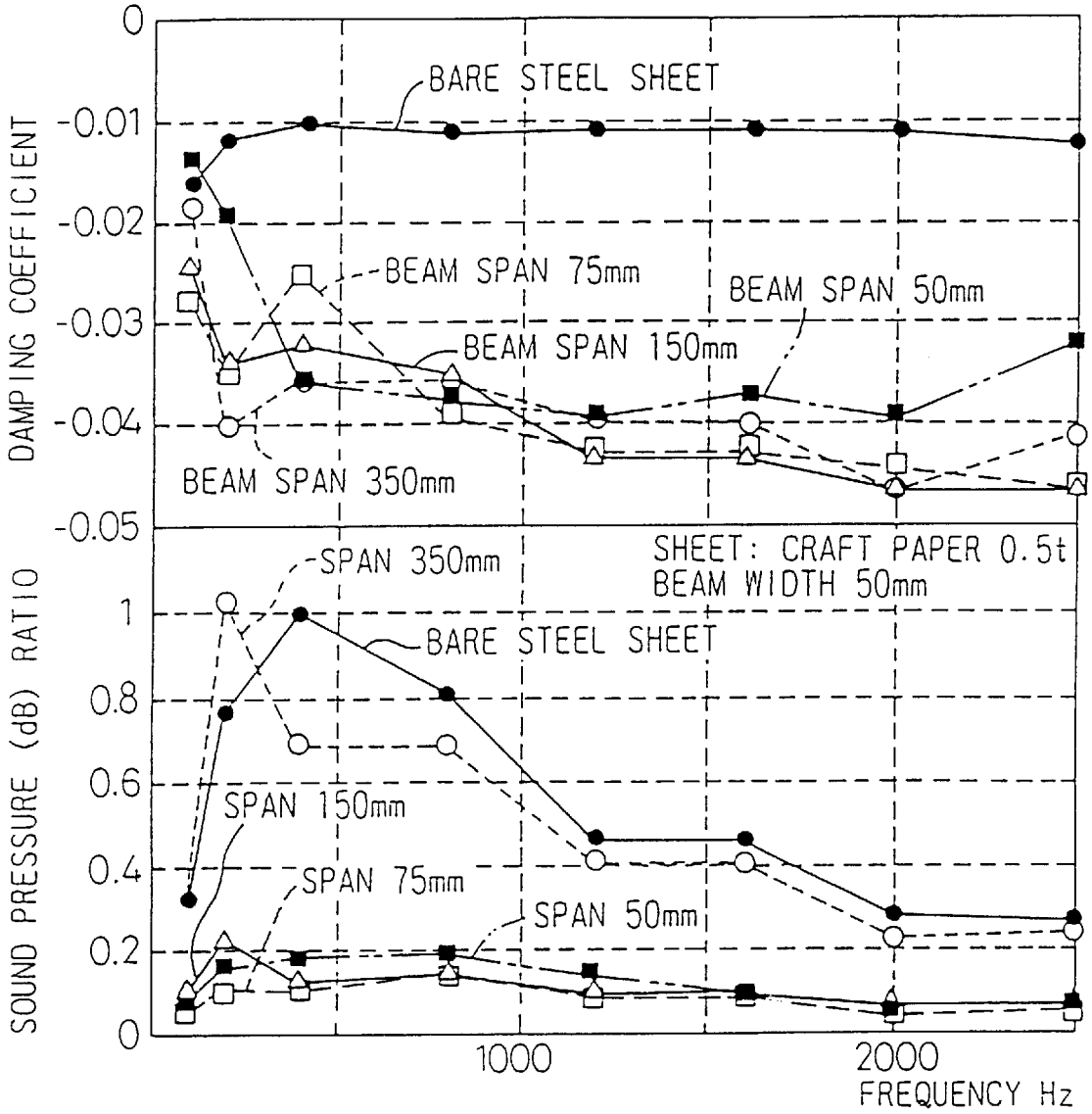
FIG. 8 is an analytical diagram showing comparatively the difference of the effects of a support span of reinforcing beams of the present invention in comparison with a Comparative Example (frequency-v-sound pressure diagram and frequency-v-damping coefficient diagram)

As shown in FIG. 8, the damping effect (acoustic effect of the thin metallic external sheet 1 and the sound damping sheet 3) hardly exists at the support span of 350 mm, but the maximum sound pressure can be suppressed by the existence of the sound damping sheet 3 on the reinforcing beams. As can be understood from the graph, this suppression effect hardly has any relation with the support span. It can be further understood from the graph that the sound damping effect is substantially the same when the support span is not greater than 150 mm.

The effect of the width (cover zone) of the sound damping sheet 3 will be explained by an example wherein the width of the sound damping sheet is changed from a width covering substantially the entire inner surface of the thin metallic external plate to a width of 20 mm covering only the reinforcing beam portion in the rectangular form.

Figure 9:
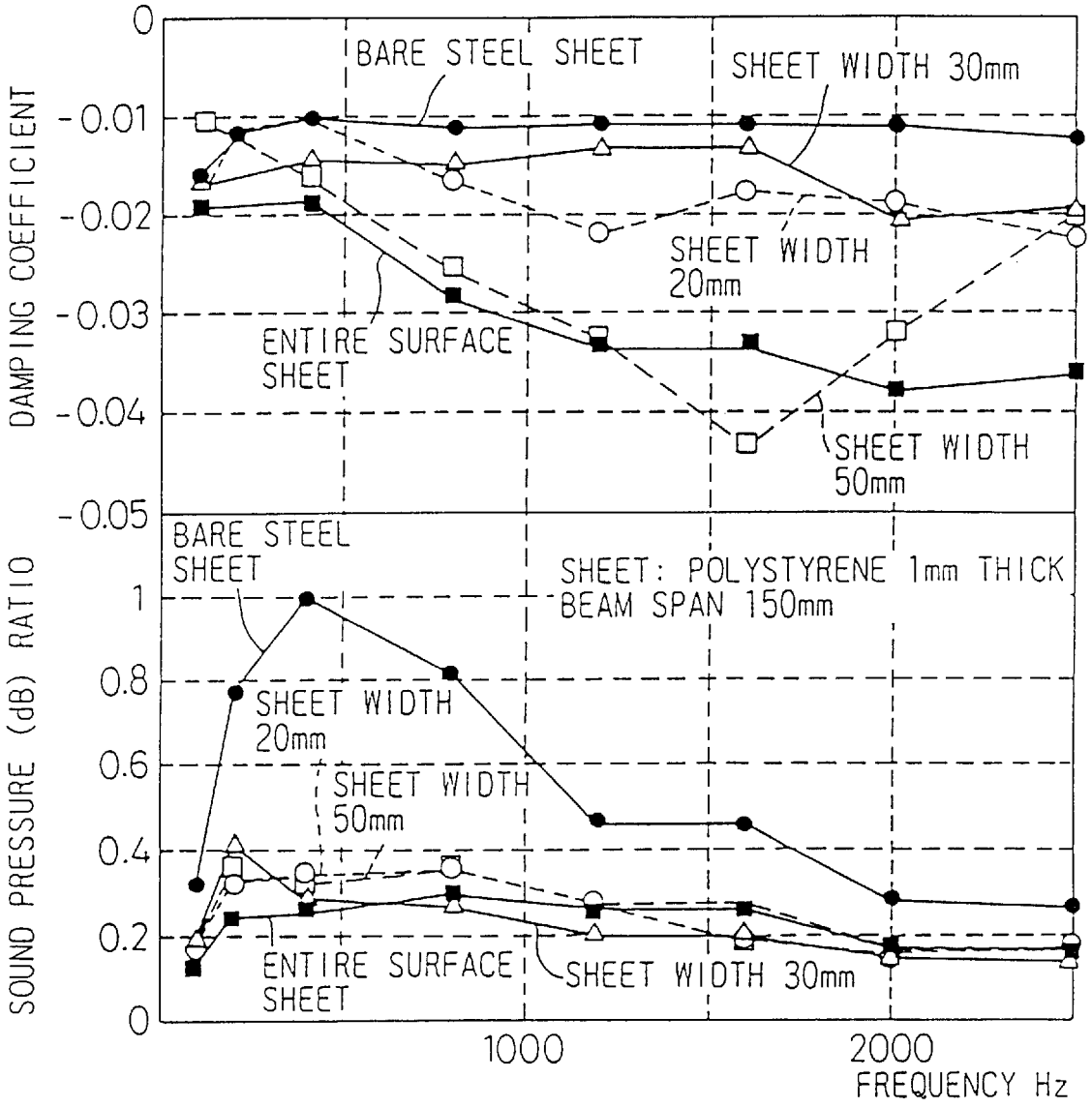
FIG. 9 is an analytical diagram showing comparatively the difference of the effects by the width (cover zone) of the sound damping sheet of the present invention in comparison with a Comparative Example (frequency-v-sound pressure diagram and frequency-v-damping coefficient diagram)

As shown in FIG. 9, it is most preferred in connection with the width of the sound damping sheet 3 that the width covers substantially the entire inner surface of the thin metallic external sheet 1, from the aspect of the sound damping effect. However, when the structure wherein the sound damping sheet 3 cannot be pressed to substantially the entire inner surface of thin steel external sheet 1 for reasons of production cost or design or, in other words, when the sound damping sheet 3 is divided into the rectangular shape and is fitted to the reinforcing beams 2, the sound damping effect can still be sufficiently obtained by setting the width of the sound damping sheet to at least 50 mm (the support span of the thin steel external sheet 1 of not greater than 150 mm), as can be understood from the graph. As described above, because the maximum sound pressure can be suppressed by the existence of the sound damping sheet on the reinforcing beams (see FIG. 8), the suppression effect hardly has any relation with the width of the sound damping sheet. In this way, a required sound damping can be obtained, in accordance with the grade of the product, by selecting a suitable width of the sound damping sheet and the support span.

INDUSTRIAL AVAILABILITY

As described above, the present invention can lower the sound pressure level of the metallic reflection sound occurring when the thin metallic external sheet 1 is patted, by the vibration absorbing effect of the sound damping sheet 3 on the inner surface, and can provide large sound damping characteristics. Therefore, the present invention can provide a thin metallic sheet structure having reflection sound characteristics devoid of offensive sound, or in other words, having tone quality and quietness providing a feeling of high quality. Since the present invention comprises the thin metallic external sheet and reinforcing beams and a sound damping sheet which can be easily removed, the present invention can provide products which have excellent recycling properties.

We claim:

1. A thin metallic sheet structure having excellent sound damping characteristics, said structure comprising:

a thin metallic external sheet having a contact surface;

beams for reinforcing said thin metallic external sheet;

a sound damping sheet disposed between said contact surface of said thin metallic external sheet and said beams;

wherein said beams contact said contact surface of said thin metallic external sheet through said sound damping sheet;

wherein coupling between said sound damping sheet and at least one of said thin metallic external sheet and said beams is one of a non-coupling state or a discrete coupling state;

wherein a non-coupling state means a frictional damping connection; and wherein a discrete coupling state means gaps of frictional damping connection between direct coupling.

2. A thin metallic sheet structure having excellent sound damping characteristics according to claim 1 further comprising:

said beams are formed from a material selected from the group consisting of plastic and plastic composite material; and said coupling between said beams and said sound damping material is one of a non-coupling state or a discrete coupling state.

3. A thin metallic sheet structure having excellent sound damping characteristics according to claim 1, wherein said sound damping sheet comprises a plastic sheet, paper, a rubber sheet or a woven fabric sheet.

4. A thin metallic sheet structure having excellent sound damping characteristics, said structure comprising:

a thin metallic external sheet having a contact surface;

beams for reinforcing said thin metallic external sheet directly contacting said contact surface of said thin metallic external sheet with resulting non-reinforced areas of said contact surface of said thin metallic external sheet located between beams;

a sound damping sheet supported by support members contacting at least a portion of said non-reinforced areas of said contact surface of said thin metallic external sheet;

wherein coupling between said sound damping sheet and said non-reinforced areas of said contact surface of said thin metallic external sheet is one of a non-coupling state and a discrete coupling state;

wherein a non-coupling state means a frictional damping connection; and wherein a discrete coupling state means gaps of frictional damping connection between direct coupling.

5. A method of using a thin metallic sheet structure according to claim 1 as a box for an electric home appliance such as a television receiver.

6. A method of using a thin metallic sheet structure according to claim 2 as a box for an electric home appliance such as a television receiver.

7. A method of using a thin metallic sheet structure according to claim 4 as a box for an electric home appliance such as a television receiver.

* * * * *